US006086980A

United States Patent [19]

Foster et al.

[11] Patent Number: 6,086,980

[45] Date of Patent: Jul. 11, 2000

[54] METAL WORKING DRILL/ENDMILL BLANK AND ITS METHOD OF MANUFACTURE

[75] Inventors: Stephen Foster; Gary McCarthy; Alistair Grearson, all of West Midlands, United Kingdom; Héléne Ouchterlony, Ingarö , Sweden

[73] Assignee: Sandvik AB, Sandviken, Sweden

[21] Appl. No.: 08/993,243

[22] Filed: Dec. 18, 1997

[51] Int. Cl.[7] ..... B32B 7/00

[52] U.S. Cl. ..... 428/212; 51/255; 51/307; 51/309; 75/228; 75/236; 75/237; 75/241; 75/242; 407/119; 427/419.1; 427/419.2; 427/419.7; 428/334; 428/325; 428/698; 428/701; 428/702

[58] Field of Search ..... 428/698, 325, 428/216, 334, 336, 701, 702, 712; 51/295, 307, 309; 407/119; 75/228, 236, 237, 241, 242; 427/419.1, 419.2, 419.7

[56] References Cited

U.S. PATENT DOCUMENTS

| | | | |
|---|---|---|---|
| 4,743,515 | 5/1988 | Fischer et al. . | |
| 5,145,739 | 9/1992 | Sarin | 428/336 |
| 5,541,006 | 7/1996 | Conley . | |
| 5,543,235 | 8/1996 | Mirchandani et al. . | |
| 5,679,445 | 10/1997 | Massa et al. | 428/212 |
| 5,780,139 | 7/1998 | Canfer et al. | 428/217 |
| 7,971,485 | 11/1990 | Nomura et al. . | |

FOREIGN PATENT DOCUMENTS

| | | |
|---|---|---|
| 977873 | 6/1951 | France . |
| 6137 | 7/1952 | Germany . |

*Primary Examiner*—Archene Turner

*Attorney, Agent, or Firm*—Burns, Doane, Swecker & Mathis, L.L.P.

[57] ABSTRACT

A cemented carbide drill/endmill blank and method of manufacture thereof wherein the drill/endmill includes a core and a surrounding tube with improved technological properties. The difference in Co-content between the core and tube is 1–10 wt-% units and the cubic carbide content is 8–20 wt-% in the tube and 0.5–2 wt-% in the core.

20 Claims, 1 Drawing Sheet

METAL WORKING DRILL/ENDMILL BLANK AND ITS METHOD OF MANUFACTURE

FIELD OF THE INVENTION

The present invention relates to a cemented carbide body, preferably a cylindrical body consisting of at least two grades with individually different compositions, microstructures and properties, especially a body aimed at acting as a blank for a drilling, endmilling or deburring tool.

BACKGROUND

In drilling tools the demands on the periphery and on the center are different with respect to wear resistance and toughness. In drill bits for rock drilling the demands differ between the surface (wear resistance) and the inner part (toughness) as discussed in U.S. Pat. No. 5,541,006, in which is emphasized the use of two grades in a rock drilling bit. The grades are both straight grades with tungsten carbide and Co. Much attention is given to the ability to control the Co migration for which, in this case, an abrupt or discrete change of composition at the interface between the regions is preferred. This problem is also solved by Fischer with the technique known as Dual-Phase or DP-technique, U.S. Pat. No. 4,743,515. Tools as wear parts, rolling rings and slitter/trimming knifes can be manufactured with a method described in U.S. Pat. No. 5,543,235.

These patents, though, deal with combinations of grades containing only WC—Co or WC—Ni. They also refer to applications where just one of the grades is in contact with the work piece material, and the other serves as an 'equalizer' or carrier' of pressure or impact.

One patent dealing with cemented carbide drills containing cubic carbides is U.S. Pat. No. 4,971,485, but in that case the WC—Co grade is used in the shaft to avoid damage due to vibrations emanating from the machine.

The present invention relates to a compound cemented carbide body consisting of a core of a tough grade and a surrounding tube of a more wear resistant grade that are both in active contact with the work piece material. The problem when making such a compound body is to avoid the formation of cracks in the outer part or voids and significant porosity at the interface between the two parts due to differences in shrinkage during sintering. In addition, too high stresses in the interface make further manufacturing, e.g., slitting and grinding, impossible. Another problem can be the migration of the binder phase during sintering which results in a leveling of the binder phase content in the two parts. The combination of grades has to fulfil the demands on toughness and wear resistance in the center as well as in the periphery. The grades also have to be compatible with respect to pressing conditions and sintering conditions.

SUMMARY OF THE INVENTION

It is an object of the invention to overcome shortcomings of the prior art.

According to the invention it has been found possible that by a proper choice of composition and microstructure of the two grades the above mentioned problems can be avoided. More particularly, the invention relates to a drill blank with a core of a WC—Co-grade surrounded by a tube of a grade containing also carbides and/or carbonitrides of the elements in group 4–6, preferably Ti, Ta and Nb.

DETAILED DESCRIPTION OF THE INVENTION

Figure 1:
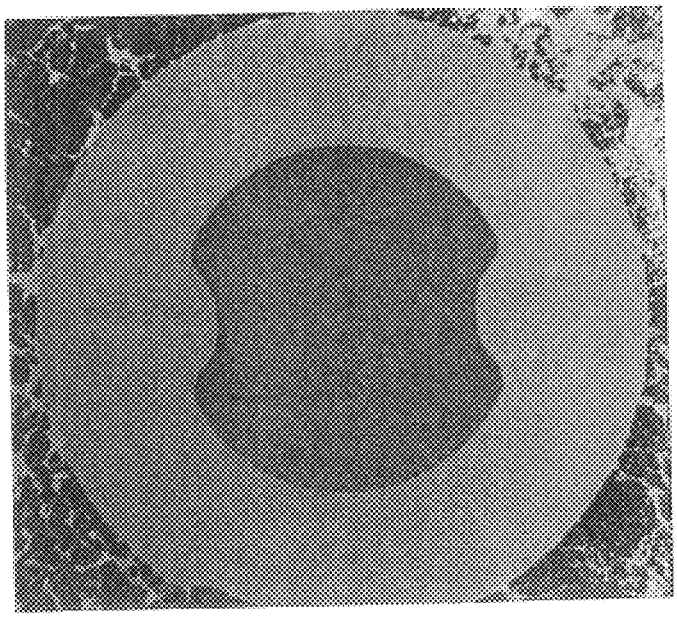
FIG. 1 shows in 6× magnification a cross section of a drill blank according to the invention wherein A shows the core and B shows the tube.
Figure 2:
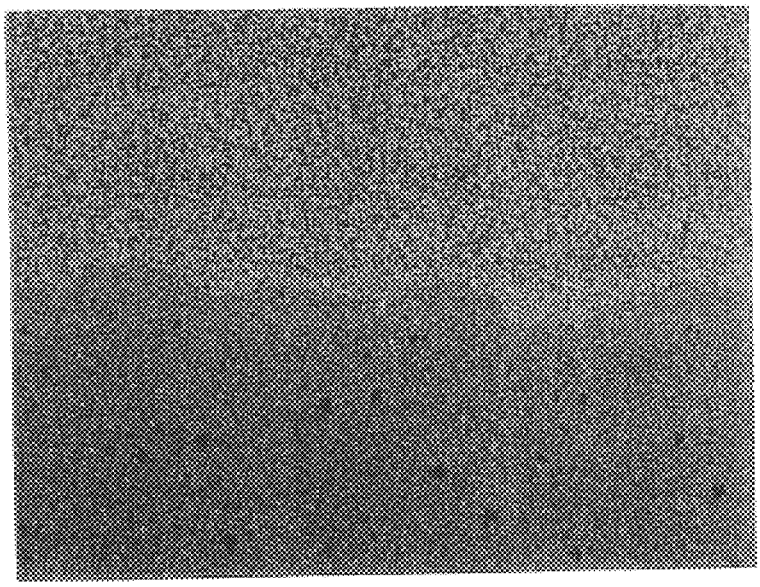
FIG. 2 shows in 200× magnification the diffuse interface between the two grades.

Drill blanks according to the invention consist of a core and a surrounding tube. The core contains after sintering a Co content of <30, preferably 5–20, most preferably 10–15 wt-% Co, balance WC. In addition to WC, the tube grade has >5 wt-% Co and 5–25, preferably 8–20 wt-%, most preferably 10–15 wt-% of one or more of the carbides and/or carbonitrides of the elements in Groups 4–6 of the Periodic Table, preferably Ti, Ta and Nb. The difference in Co content between core and tube is 1–10 wt-% units, preferably 2–4 wt-% units. There is a 300–500 $\mu$m wide transition zone measured as a change in Co-content by microprobe analysis. The core may optionally contain 0.5–2 wt-% cubic carbides.

The grain size of the core grade is <10 $\mu$m, preferably 0.5–5 $\mu$m, most preferably 0.5–3 $\mu$m. The tube grade has a grain size of <10 $\mu$m, preferably 0.5–3 $\mu$m, most preferably 0.5–1.5 $\mu$m.

Blanks according to the invention are made by powder metallurgical methods including compacting in two steps. As an example, a rod with length around 300 mm and diameter 5–15 mm consisting of 10–30 wt-% Co and balance WC with grain size <10 $\mu$m is pressed. Preferably, this rod has a grooved form which provides a keying action between it and the surrounding tube. Then a tube of a desired diameter is pressed around the outside of the rod to final green density. The size of the core is preferably 40–60% of the total diameter of the blank. If desired the drill blank can be provided with coolant holes by methods known to those skilled in the art. It has been found that if the difference in Co-content between the tube grade and the core grade is 0–15 wt-% units, preferably 5–10 wt-% units and the tube contains cubic carbides as mentioned above, the blank can be sintered without formation of cracks or voids between the core and the tube.

The pressing and sintering properties of the original grade powders are of utmost importance to get a good result. Pressing conditions are determined by thermal expansion coefficient, shrinkage and required pressing pressure for the grades used. It is within the purview of the skilled artisan to determine these conditions by experiments. Sintering is preferably performed at 1350–1450° C.

After sintering, the rods are usually cut into drill blanks of 50–150 mm, preferably 80–120 mm length. The most useful diameter range is 5–35 mm, preferably 5–20 mm.

The flute is ground with for example a diamond wheel at 18–20 m/sec with a feed of 60–80 mm/min.

In an alternative embodiment, a drill top of length/diameter ratio of 0.5–5.0 is used which is brazed to a shaft.

After finish grinding, drills of the above mentioned kind are suitable for coating by vapor deposition such as PVD with carbide, nitride, carbonitride or oxide or combinations thereof, e.g., TiN, TiAlN, Ti(C,N).

Drills of this invention are particularly useful for machining of stainless steel and normal steel.

EXAMPLE 1

Drills according to the invention were produced by pressing in two stages. First, a cylindrical rod having a length of 300 mm and diameter of 11 mm with a composition of 20 wt-% Co and 80 wt-% WC and grain size 2 $\mu$m was pressed. Then, a powder with original composition of 11 wt-% Co, 6.1 wt-% TaC, 1.9 wt-% NbC, 4 wt-% TiC and balance WC and grain size 2.5 μm was pressed around the outside of the rod to final green density. Some of the drills were provided with coolant holes according to a technique well known in the art. After sintering, the Co content of the core grade had decreased from 20 to 14 wt-% and the Co content in the tube grade had increased to 12 wt-%. In addition, significant amounts of the cubic carbides could be detected in the center of the core.

After sintering, the rods were cut into drill blanks of 105 mm length and 14 mm in diameter. The flute and top and bottom of the blanks were ground to final appearance.

EXAMPLE 2

PVD TiN coated drills from Example 1 were tested by drilling in stainless steel AISI 316. Single grade drills of the two original grades used in the drills from Example 1 and one fine grained 1 μm WC— 10 wt-% Co grade normally used in these cutting conditions were used as references.

The following three test conditions were used with external cooling:

a) v=50 m/min, f=0.14 mm/rev b) v=82 m/min, f=0.12 mm/rev c) v=32 m/min, f=0.22 mm/rev In test a) the drill according to the invention lasted 357 holes, while the single grade drills were worn out after 207 holes (single grade fine grained WC—Co), 149 holes (single grade 11 wt-% Co, 12 wt-% Ta, Nb, Ti carbides, rest WC) and 55 holes (single grade 20 wt-% Co).

At higher speed and lower feed in test b) the drill according to the invention and the fine grained grade made 192 holes while the other single grades made 126 holes (single grade 9 wt-% Co) and 22 holes (single grade 20 wt-% Co).

At lower speed with higher feed in test c) the result was 179 holes for the drill according to the invention while the fine grained grade made 128 holes and the 20 wt-% Co grade made 41 holes before they were stopped because of cracks or wear.

EXAMPLE 3

Drills from Example 1 provided with internal coolant supply holes were tested by drilling in stainless steel. In this test an ordinary P40 drill was used as a reference.

At increased speed (100 m/min, f=0.16 mm/rev) the drill according to the invention drilled 550 holes while the P40 reference drill was totally broken down after only 3 holes.

At normal speed but a higher feed (50 m/min, f=0.25 mm/rev) the P40 drill suffered from chipping after 660 holes and the drill according to the invention was still working after 1100 holes.

At ordinary cutting speed and feed (50 m/min, f=0.16 mm/rev) the two drills were equal in performance and the test was interrupted after 1100 holes.

EXAMPLE 4

Drills from Example 1 provided with internal coolant supply holes were tested on austenitic stainless steel, AISI 304. In this test ordinary P40 and sub-micron K20 drills were used as references.

At normal speed (50 m/min, f=0.16 mm/rev) the drill according to the invention was still working after 2668 holes while the P40 and sub-micron K20 drills were worn out after 2011 and 242 holes, respectively.

At increased feed but normal speed (50 m/min, f=0.30 mm/rev) the drill according to the invention completed 520 holes while the P40 and sub-micron K20 drills completed 110 and 22 holes, respectively.

At increased speed (100 m/min, f=0. 16 mm/rev) the drill according to the invention achieved 198 holes, while the P40 and K20 drills broke down after 1 or 2 holes.

EXAMPLE 5

Drills from Example 1 with internal coolant supply holes, but in 10 mm diameter and coated with Ti(C,N) and TiN were tested by drilling AISI 316 (SS2353), 30 mm through hole drilling. In this test an ordinary fine grained PVD coated drill was used as a reference. Several cutting data combinations were used, and from the results shown below, the drill according to the invention has a much broader working range compared to a conventional drill.

The table below shows the number of holes achieved with the drills used in the test. The test was stopped after 1300 holes even though the drills were not worn out.

| Cutting Data | | | | | | |
|---|---|---|---|---|---|---|
| Speed (m/min) | 40 | 40 | 40 | 60 | 60 | 60 |
| Feed (mm/rev) | 0.13 | 0.20 | 0.25 | 0.13 | 0.20 | 0.22 |
| Ordinary drill | 600 | 100 | — | 100 | 3 | — |
| Drill according to the invention | >1300 | 400 | 500 | >1300 | >1300 | 500 |

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A cemented carbide drill/endmill blank comprising a core of one cemented carbide grade and a surrounding tube of another cemented carbide grade, the blank having a difference in Co-content between the core and tube of 1–10 wt-% units, the tube having a cubic carbide content of 8–20 wt-% and the core having a cubic carbide content of 0.5–2 wt-%.

2. The cemented carbide drill/endmill blank of claim 1, wherein the core includes 5–20% Co, 0.5–2 wt-% cubic carbides, balance WC.

3. The cemented carbide drill/endmill blank of claim 1, wherein the tube includes 5–25 wt-% Co, 8–20 wt-% carbides and/or carbonitrides of Ti, Ta and/or Nb, balance WC.

4. The cemented carbide drill/endmill blank of claim 1, wherein the core and tube are joined by a 300–500 μm wide transition zone wherein the Co content varies such that a difference in Co-content between the core and tube is at least 2 wt-% units.

5. The cemented carbide drill/endmill blank of claim 1, wherein prior to sintering the difference in Co-content between the core and tube is greater than 3 wt-% units, the cemented carbide grade of the core has a grain size of <10 μm and the cemented carbide grade of the tube has a grain size of <10 μm, and wherein after sintering the difference in Co-content between the core and tube is less than 5 wt-% units.

6. The cemented carbide drill/endmill blank of claim 1, wherein the cemented carbide grade of the core has a grain size of 0.5–5 μm and the cemented carbide grade of the tube has a grain size of 0.5–3 μm.

7. The cemented carbide drill/endmill blank of claim 1, wherein the tube has a diameter of 5–35 mm.

8. The cemented carbide drill/endmill blank of claim 1, wherein the tube includes one or more flutes ground into an outer surface thereof.

9. The cemented carbide drill/endmill blank of claim 1, wherein the tube is coated with one or more carbide, nitride, carbonitride or oxide coatings.

10. A method of drilling stainless steel with the cemented carbide drill/endmill blank of claim 1.

11. A method of making the cemented carbide drill/endmill blank of claim 1 comprising steps of compacting the cemented carbide powder of the core followed by compacting the cemented carbide powder of the tube around the core.

12. The method of claim 11, further comprising sintering the compacted core and compacted tube such that the core and tube are joined by a 300–500 μm wide transition zone wherein the Co content varies such that a difference in Co-content between the core and tube is at least 2 wt-% units.

13. The method of claim 11, further comprising forming at least one groove in an outer periphery of the core prior to compacting the tube around the core.

14. The method of claim 11, further comprising forming coolant holes in the blank.

15. The method of claim 11, further comprising sintering the compacted core and compacted tube such that the Co content of the core decreases and the Co content of the tube increases.

16. The method of claim 11, further comprising grinding at least one flute into the blank.

17. The method of claim 11, wherein the core includes 5–20% Co, 0.5–2 wt-% cubic carbides, balance WC, and the tube includes 5–25 wt-% Co, 8–20 wt-% carbides and/or carbonitrides of Ti, Ta and/or Nb, balance WC.

18. The method of claim 11, wherein the cemented carbide grade of the core has a grain size of <10 μm, the cemented carbide grade of the tube has a grain size of <10 μm, and the core has a diameter of 40–60% of the tube diameter.

19. The method of claim 11, wherein the tube has a diameter of 5–35 mm.

20. The method of claim 11, further comprising coating the tube with one or more carbide, nitride, carbonitride or oxide coatings.

* * * * *